United States Patent [19]

Lanese

[11] 4,086,646

[45] Apr. 25, 1978

[54] SYSTEM FOR THE CONTROL OF RAPPERS IN AN ELECTROSTATIC PRECIPITATOR

[75] Inventor: Philip M. Lanese, Belle Mead, N.J.

[73] Assignee: Belco Pollution Control Corporation, Parsippany, N.J.

[21] Appl. No.: 755,520

[22] Filed: Dec. 30, 1976

[51] Int. Cl.[2] ..... H01H 47/32

[52] U.S. Cl. ..... 361/166; 55/112

[58] Field of Search ..... 361/166, 168, 169; 55/112; 340/225

[56] References Cited

U.S. PATENT DOCUMENTS

| | | | |
|---|---|---|---|
| 3,286,234 | 11/1966 | Hogrefe | 361/168 X |
| 3,487,606 | 1/1970 | Bridges et al. | 55/112 X |
| 3,754,379 | 8/1973 | Bridges et al. | 55/112 X |
| 4,008,057 | 2/1977 | Gelfand et al. | 55/112 X |

*Primary Examiner*—Harry E. Moose, Jr.
*Attorney, Agent, or Firm*—Marvin A. Naigur; John E. Wilson

[57] ABSTRACT

A control system for energizing each of a number of rappers used to periodically rap the electrodes of an electrostatic precipitator to clean the electrodes. The control system energizes each rapper sequentially so that the coil of each rapper is periodically energized for a period of time at an energy level sufficient to provide efficient cleaning of its associated electrode.

10 Claims, 12 Drawing Figures

FIG. 2
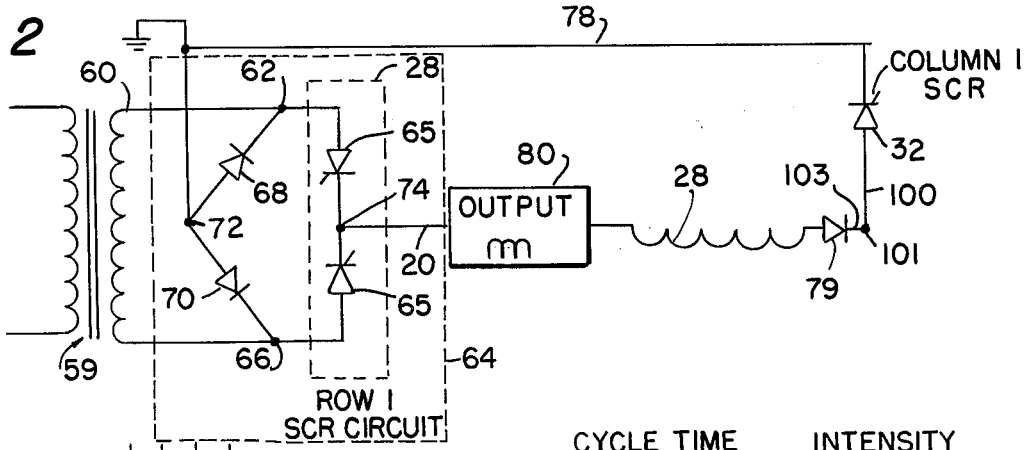
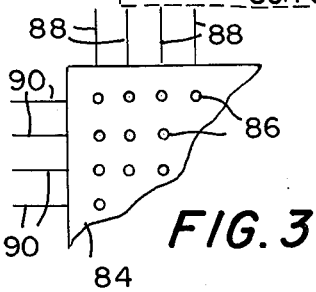
FIG. 3
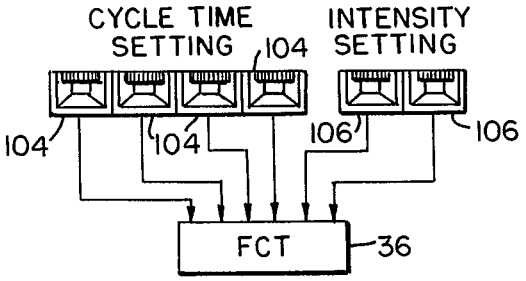
FIG. 4
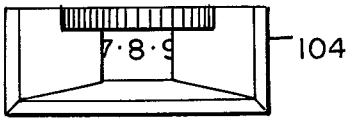
FIG. 5
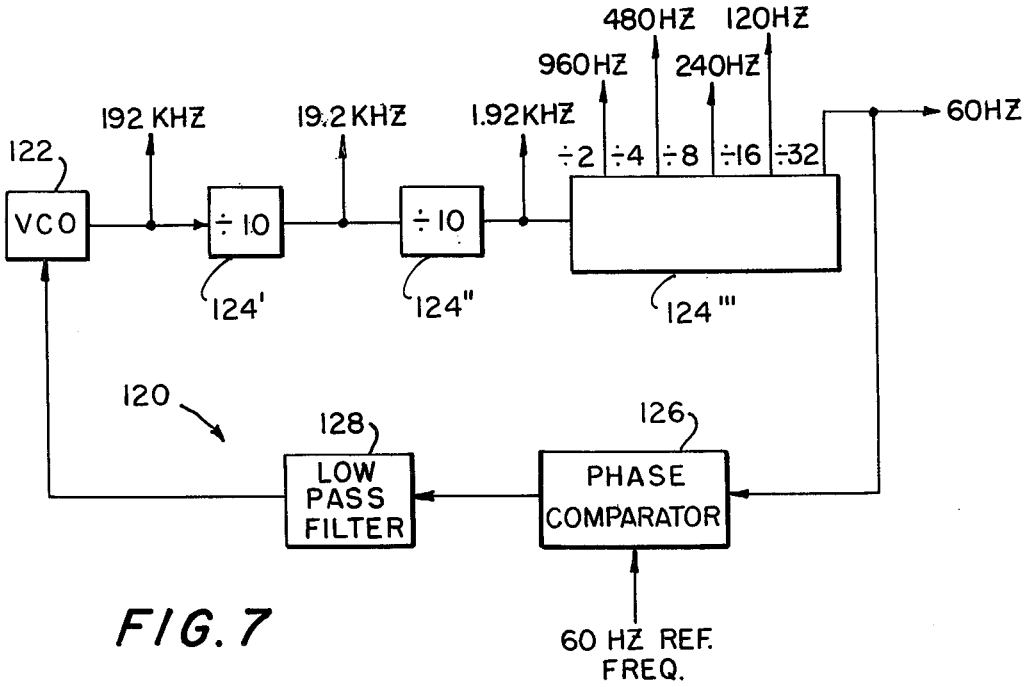
FIG. 7

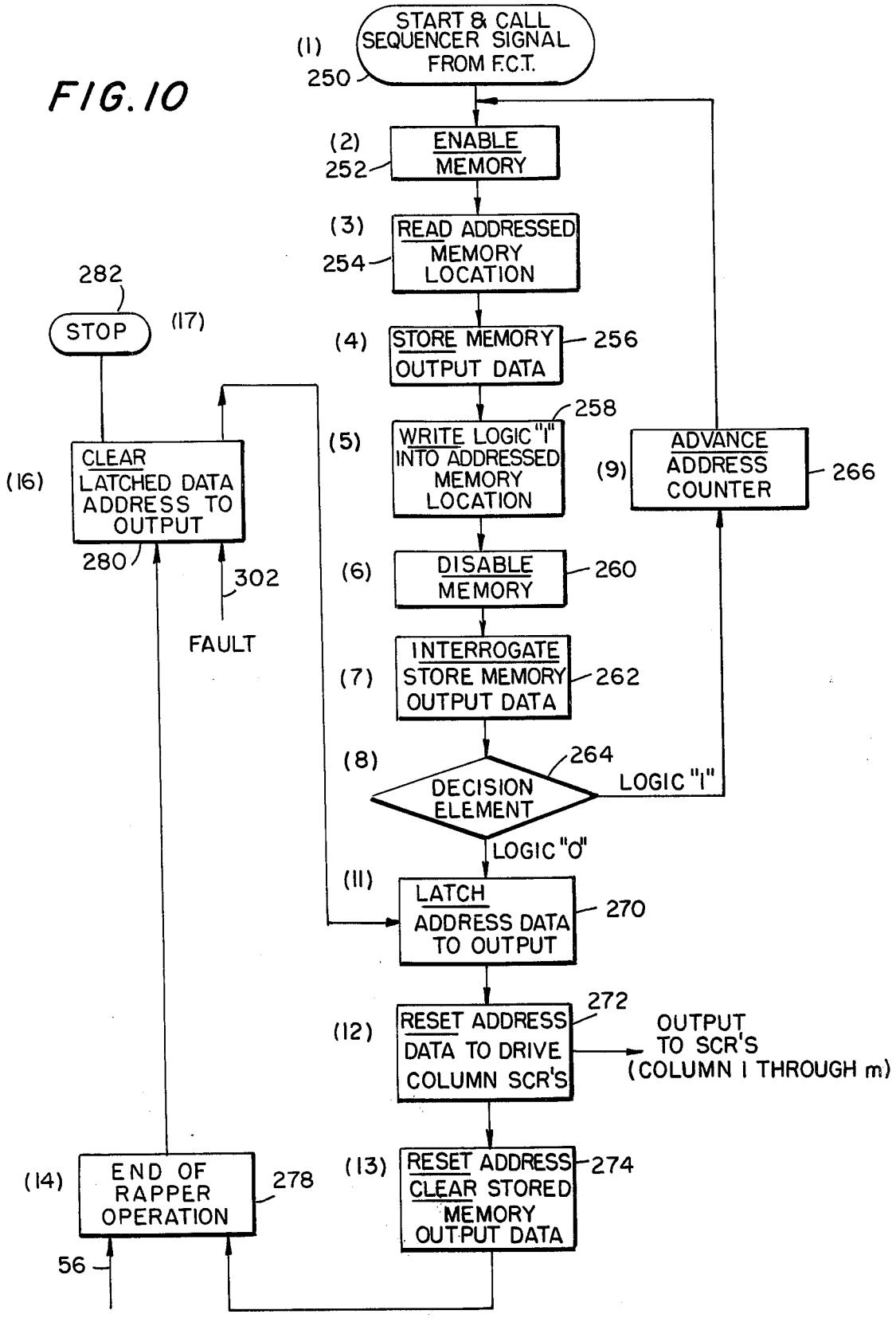
FIG. 10
START & CALL SEQUENCER SIGNAL FROM F.C.T.
(1)
250
(2)
ENABLE MEMORY
252
(3)
READ ADDRESSED MEMORY LOCATION
254
(4)
STORE MEMORY OUTPUT DATA
256
(5)
WRITE LOGIC "1" INTO ADDRESSED MEMORY LOCATION
258
(6)
DISABLE MEMORY
260
(7)
INTERROGATE STORE MEMORY OUTPUT DATA
262
(8)
DECISION ELEMENT
264
LOGIC "1"
LOGIC "0"
(9)
ADVANCE ADDRESS COUNTER
266
(11)
LATCH ADDRESS DATA TO OUTPUT
270
(12)
RESET ADDRESS DATA TO DRIVE COLUMN SCR'S
272
OUTPUT TO SCR'S (COLUMN 1 THROUGH m)
(13)
RESET ADDRESS CLEAR STORED MEMORY OUTPUT DATA
274
(14)
END OF RAPPER OPERATION
278
56
(16)
CLEAR LATCHED DATA ADDRESS TO OUTPUT
280
302
FAULT
282
STOP
(17)

SYSTEM FOR THE CONTROL OF RAPPERS IN AN ELECTROSTATIC PRECIPITATOR

BACKGROUND OF THE INVENTION

Electrostatic precipitators which use a plurality of electrodes to remove particulate matter must be cleaned periodically during operation if they are to function with any reasonable efficiency. Otherwise, the electrodes will be coated with the particulate matter which has been removed from the air or other gas circulating through the precipitator and will no longer attract the particulate matter with any reasonable degree of efficiency.

A common way to clean the electrodes is to provide rappers wich are mechanically connected with one or more electrodes. While the precipitator is in operation, each rapper is intermittently operated to vibrate an electrode or electrodes thus causing the accumulated particulate matter to drop off. Each rapper is conventionally composed of a solenoid coil encircling a core which strikes an anvil when the solenoid is energized. The anvil is mechanically connected with one or more electrodes which are vibrated when the anvil is struck by the core.

Rectified AC current is conventionally used as current to energize the rappers. To efficiently clean the electrodes, the rappers have to be energized at an amplitude and for a period of time which will provide efficient cleaning. The electrodes become coated with several layers of particulate matter and if vibrated too severely by the rappers, will release all of the particulate matter. If all of the particulate matter from a particular electrode is released, an excessive quantity of matter will be in the stream of gas moving through the precipitator and will not be entirely removed before leaving the precipitator.

It has been found that if an electrode is cleaned by vibrating it properly, it is possible to cause the layer of particles in contact with the electrode to drop down while the layers of matter farther away from the electrode move toward the electrode to take the place of the particles which have dropped. Very few, if any particles will be released to the gas stream and therefore, the precipitator will not lose particles to the gas moving through it.

In the past some difficulty has been encountered in providing the control of current used to actuate the precipitators. Control systems previously used did not always energize each rapper for a period which will provide for efficient cleaning of the electrodes or frequently enough to ensure that the electrodes are sufficiently cleaned to efficiently remove particulate matter from the gases being treated by the precipitator.

SUMMARY OF THE INVENTION

It is an object of the present invention to overcome drawbacks found in the prior art such as those discussed above. Accordingly, a control system is provided for applying rectified A.C. pulses of selected intensity to the cross wires of a matrix of rows and columns of individual rapper solenoid coils, the terminals of which connected to said wires adjacent the crossings thereof for continuously supplying said coils with such pulses in sequence one after another by row and column. The system has means for automatically distributing to the wires the pulses in a certain timed sequence such that the wires of one parallel set are connected in turn to the pulse source and the wires of the other set are connected in turn to the pulse source as each wire of the first set is connected thereto, whereby each coil is energized in sequence one after the other.

BRIEF DESCRIPTION OF THE DRAWINGS

FIG. 2 is a circuit diagram of a rapper coil and D.C. energizing circuit under the output pulse control of row and column SCR's;

FIG. 3 is a fragmentary view in front elevation of a display panel for indicating the progressive operation of the rappers;

FIG. 4 is a functional diagram of the cycle time setting thumbwheels and rap intensity setting thumbwheels associated with a field cycle time board;

FIG. 5 is an enlarged view in side elevation of a thumbwheel;

FIG. 7 is a block diagram of the phase locked loop circuit;

FIG. 10 is a flow diagram showing functions performed by the sequencer circuit board;

DESCRIPTION OF THE PREFERRED EMBODIMENT

Figure 1:
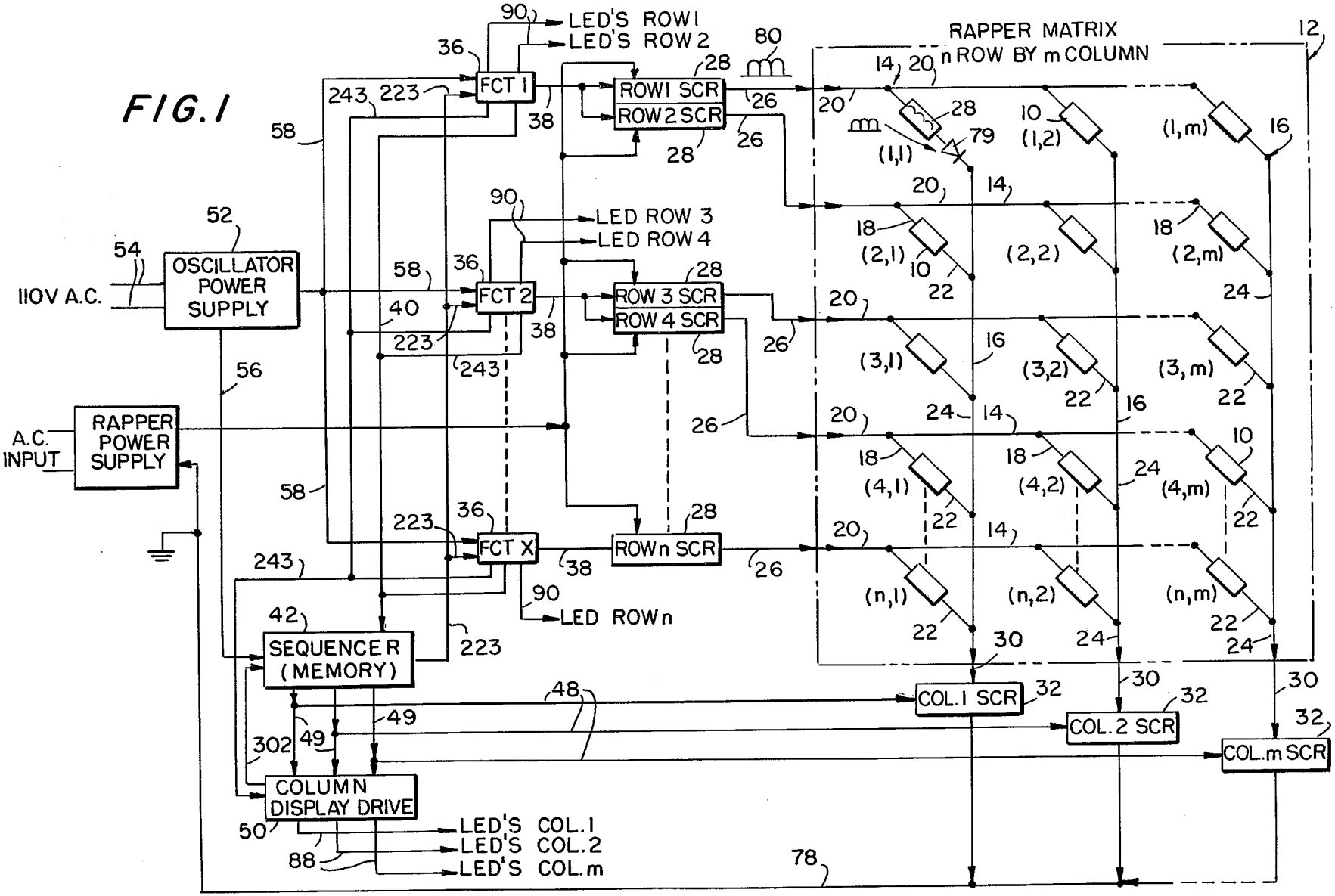
FIG. 1 is a schematic block diagram showing a rapper control system illustrative of the invention.

As shown in FIG. 1, a plurality of electrode rappers 10 in an electrostatic precipitator to be cleaned, are arranged in an electrical matrix 12 of rows 14, *l* through *n* shown extending horizontally columns 16, *l* through *m*, shown extending vertically. The array of rappers 10 is similar to a horizontal checkerboard, with the D.C. input leads 18 of each rapper 10 being connected to a power feed wire 20, and the output leads 22, connected to power return wires 24. Each row 14 of rappers 10 is connected by a wire 20 to the D.C. output lead 26 of a silicon controlled rectifier (SCR) circuit 28 for each row. Similarly, each column 16 of rappers 10 is connected to the output lead 30 of an SCR 32 for each column.

Field cycle time (FCT) circuits 36 are each connected by a wire 38 to an associated row SCR circuit 28. The FCT circuits 36 supply pulses to turn on the row SCR circuits 28. Each pulse is adjustable in duration. The FCT circuits 36 also connect through line 40 to a sequencer 42 comprising a memory for the system. The sequencer 42 is connected by lines 48 and 49 to the column SCR's 32, as well as to the input of a display drive circuit 50.

Signals from the FCT circuits 36 call the memory of sequencer 42 to ascertain which rapper 10 in the controlled row 14 was last operated, and supplies a pulse to the appropriate column SCR 32 to complete the D.C. circuit for energizing each rapper 10 of the controlled row in succession. An oscillator power supply 52 receives power from a 110 volt A.C. utility circuit 54, and supplies wave trains, see FIG. 8, of pulses, each wave train having fixed amplitude duration and frequency for energizing the logic system and all timing signals via wires 56 to the sequencer, and wires 58 to the FCT circuits 36.

As shown in FIG. 2, a transformer 59 has a secondary winding 60 with an output voltage of say, 240 volts, one end of which is connected to one terminal 62 of a rectifier circuit 64, and the other end of which is connected to the opposite terminal 66 thereof. The circuit 64 comprises rectifier diodes 68 and 70 having a common negative terminal 72. Row 1 SCR circuit 28 comprises two SCR's 65 which are connected in opposition to a common positive terminal 74, and to the terminals 62 and 66, respectively to complete the rectifier circuit 64. The column 1 SCR 32 and rapper coil 28 are connected in series between common negative terminal 72 of the rectifier circuit 64, and common positive terminal 74 of the Row 1 SCR circuit 28 by a wire 78. The rapper coil 28 only accepts current in the proper single direction by virtue of a series rectifier diode 79 connected in series therewith. Each rapper coil 28 is connected in series with a rectifier diode 79 in the manner explained in my co-pending applications Ser. Nos. 755,519 and 755,521. The output 80 from circuit 64 comprises a rectified D.C. pulse as shown.

As shown in FIG. 3, a rapper operation display panel 84 comprises rows and columns of light emitting diodes (LED's) 86. An individual LED 86 is provided for each rapper 10. The LED's are arranged in positions corresponding to the rapper matrix 12. This provides a visual indication of the rapping sequence during actual operation of the rappers, as well as an indication of a fault in a particular rapper. The LED's are connected to the display drive 50, FIG. 1, by wires 88; and to the FCT circuits 36 by wires 90.

As shown in FIG. 4, each FCT circuit 36 is provided with four cycle time setting thumbwheels 104, and two rap intensity setting thumbwheels 106 for manually adjusting the FCT circuit 36 to operate the rappers 10 at a selected intensity and frequency to most efficiently clean the precipitator. The thumbwheels 104 and 106 are similar, having marked settings of 1 through 9 as shown in FIG. 5.

Figure 6:
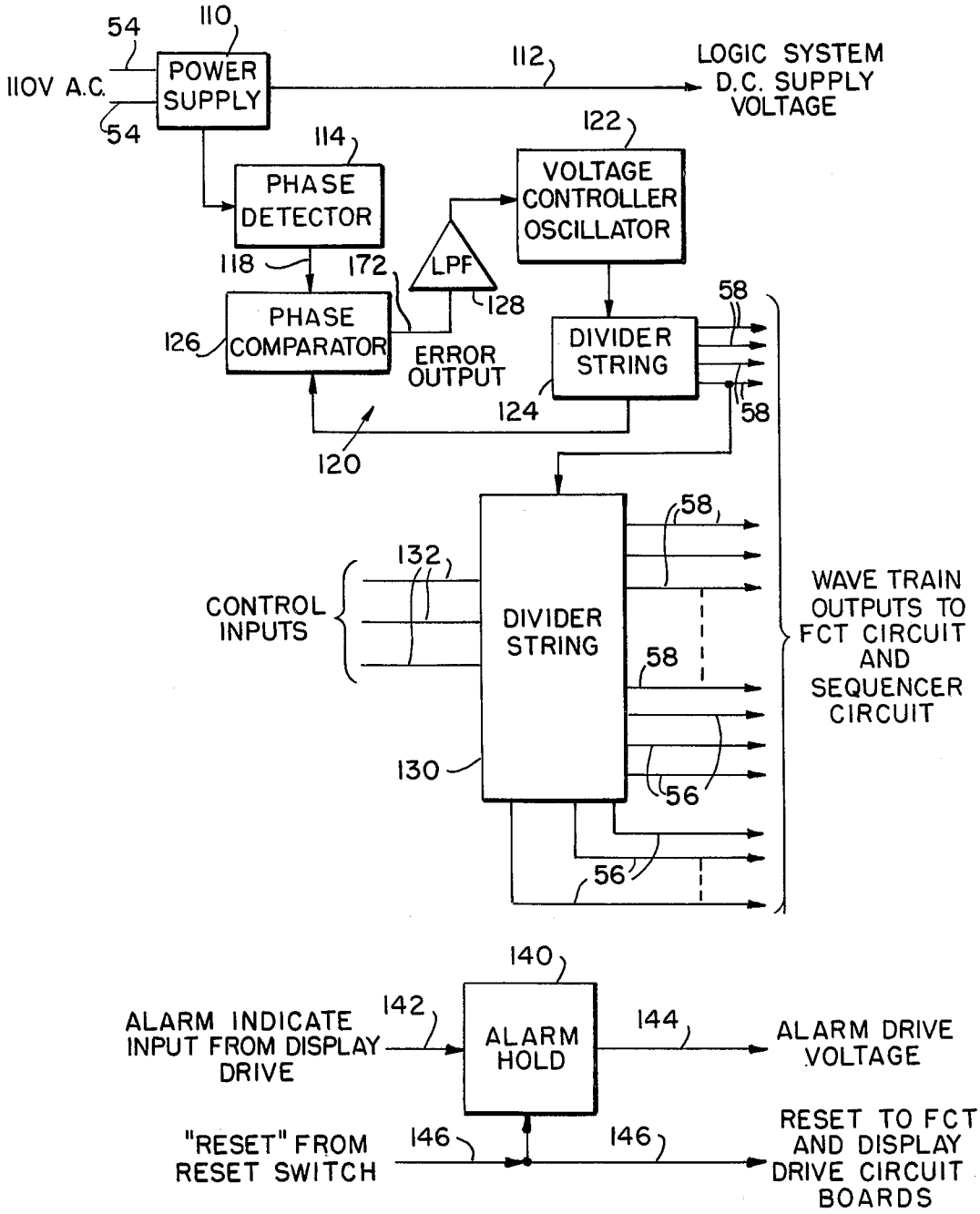
FIG. 6 is a block diagram of the oscillator/power supply circuit.

As shown in FIG. 6, the oscillator/power supply 52 has a D.C. power supply circuit 110 which provides rectified D.C. potentials to operate the electronic circuitry including the system logic voltage via output wire 112. D.C. operating potentials are made available to each component requiring an operating potential through wires which are not shown for the sake of clarity. The power supply section 110 also contains a phase detector 114 which detects the zero crossings between the positive and negative half cycles of the A.C. line voltage at 54, providing a square wave output through wire 118. The oscillator/power supply 52 also contains a phase locked loop frequency synthesizer 120 which includes a voltage controlled oscillator 122, a divider string 124, a phase comparator 126 and low pass filter 128 to provide the necessary system operating frequencies. The phase locked loop frequency synthesizer 120 is shown by itself in somewhat greater detail in FIG. 7.

The oscillator/power supply 52, contains an additional divider string 130 having control inputs 132 which further divides one of the wave trains generated by divider string 124 into several other wave trains. The wires 58 conduct some of the wave trains generated by the divider strings 124 and 130 to the FCT circuits 36 while wires 56 conduct other wave trains to the sequencer circuit 42. Also on the oscillator/power supply 52 is an alarm hold circuit 140 having an input 142 from the display drive circuit 50, FIG. 1; and an alarm drive voltage output 144. Wire 146 connects the alarm hold circuit 140 to a means for resetting the alarm hold circuit. Such means are not shown.

In operation the entire system is synchronized to the line frequency by virtue of the phase locked loop frequency synthesizer 120 shown in FIG. 7, which includes the voltage controlled oscillator 122, low pass filter 128, phase comparator 126 and frequency dividers 124, 124'' and 124'''.

Figure 8:
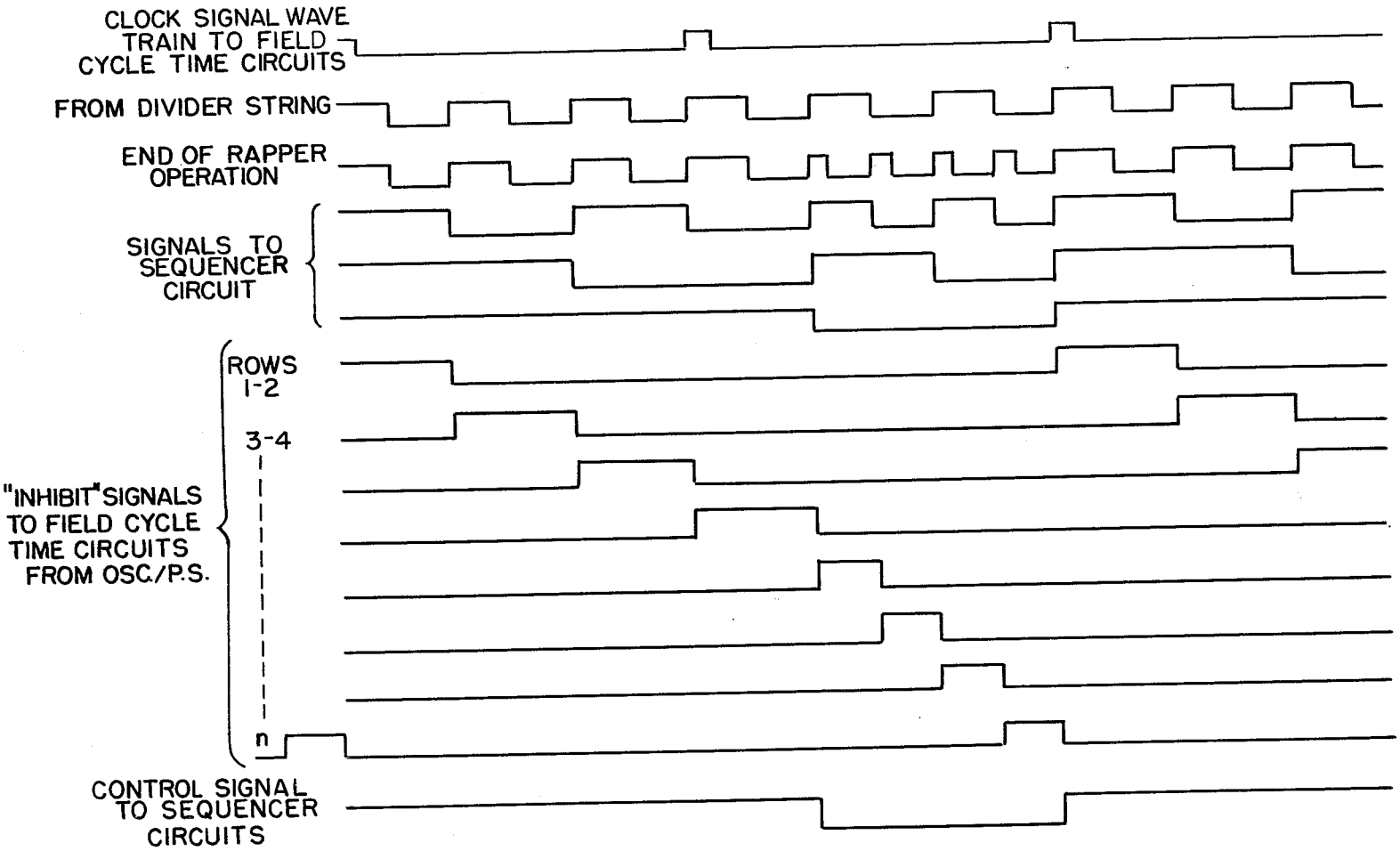
FIG. 8 is a timing diagram of the oscillator/power supply pulse trains.

FIG. 8 shows the relationship of some of the wave trains produced by oscillator/power supply 52 and conducted through wires 56 and 58.

Figure 9:
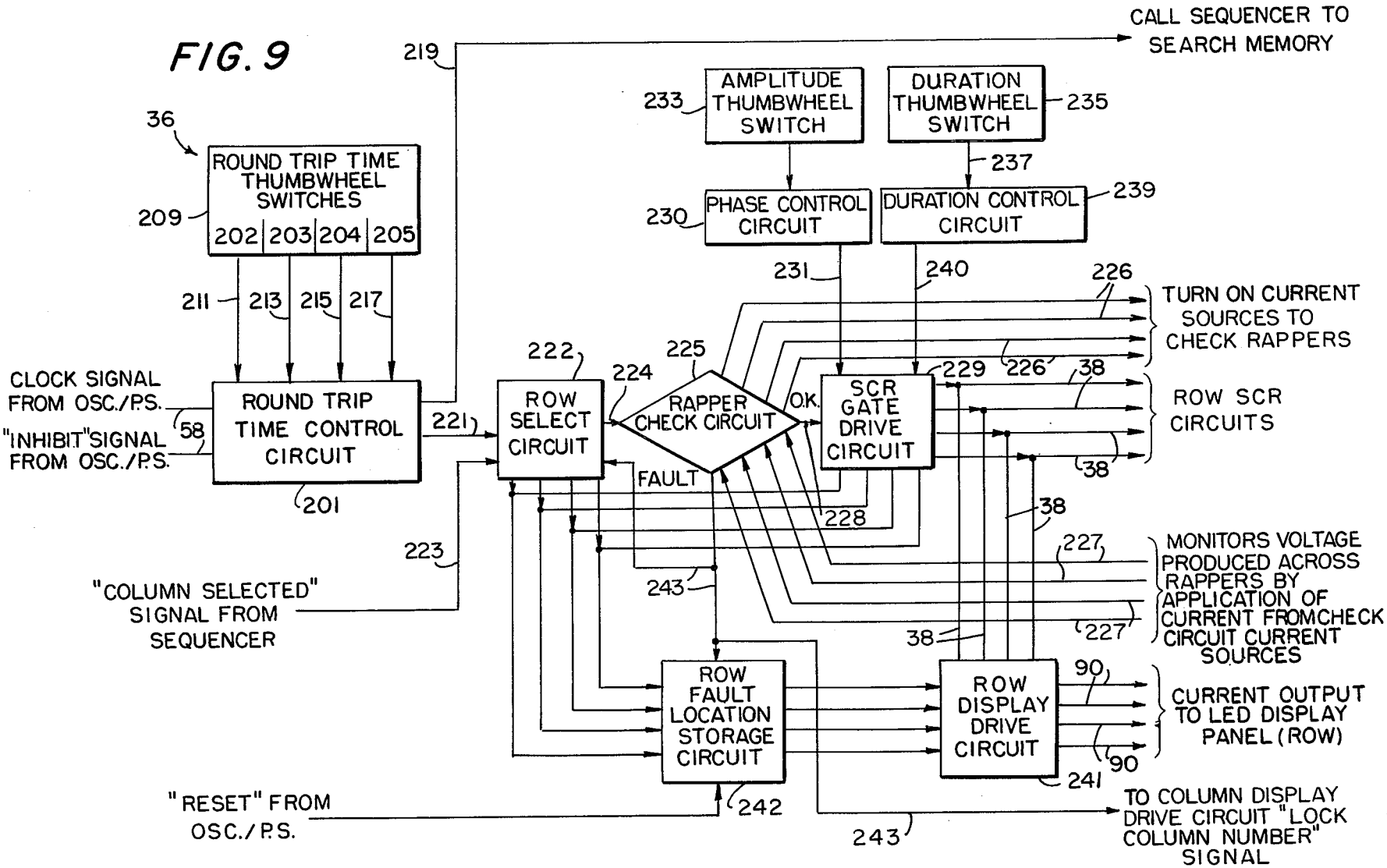
FIG. 9 is a block diagram of a field cycle time circuit.

Referring to FIG. 9, there is shown a simplified block diagram of one of the FCT circuits 36, FIG. 1. The FCT circuits 36 each include a round trip time control circuit 201 connected to receive signals from the oscillator/power supply 52 through wires 58. Round trip time thumbwheel switches 202, 203, 204 and 205, corresponding to thumbwheels 104 of FIG. 4, are associated with switch circuit 209. The switches 202, 203, 204 and 205 are connected by wires 211, 213, 215 and 217 respectively, to the round trip time control circuit 201. The control circuit 201 is provided with an output 219 to initiate operation of the sequencer circuit 42. The operation of the sequencer circuit 42 will be explained later. The control circuit 201 also has an output 221 to a row select circuit 222.

The function of row select circuit 222 is to select one of four possible row SCR circuits 28 which may be connected by wires 38 to a field cycle time circuit 36. Selection is made on the basis of information received from the sequencer circuit 42 through wire 223. Wires 224 connect the row select circuit 222 to a rapper check circuit 225. The rapper check circuit 225 then applies low voltage D.C. through one of wires 226 to the selected row. The purpose is to measure the valve of the voltage across the selected rapper coil to determine whether or not the coil is shorted or grounded. This generates a voltage of some magnitude across the coil being checked which voltage is communicated through one of wires 227 to the rapper check circuit 225 where the voltage received is compared with a predetermined voltage. If the voltage received is greater than the predetermined value, no fault is present. If the voltage received is less than or equal to the predetermined value a fault in the rapper coil being tested is indicated. If no fault is present, a signal goes through wires 228 to SCR gate drive circuit 229 having a phase control circuit 230 also connected thereto by wires 231. The circuit 230 is controlled by the setting of an amplitude thumbwheel switch 233.

Similarly, a duration thumbwheel switch 235 is connected by wires 237 to a duration control circuit 239 which, in turn, is connected by wires 240 to the SCR gate drive circuit 229. The function of phase control circuit 230 is to determine the phase angle during each half cycle of the A.C. from a rapper power supply at which the SCR's 65 in the row SCR circuit 28 will be turned on.

The function of the duration control circuit 239 is to select the number of integral cycles of A.C. from the rapper power supply during which the SCR gate drive circuit 229 will be allowed to operate. Outputs of the SCR gate drive circuit 229 are fed to row SCR circuits 28 through wires 38. Wires 38 also conduct the output of SCR gate drive circuit 229 to a row display drive circuit 241. The outputs from the row display drive circuit 241 are fed to rapper operation display panel 84 (FIG. 3).

In case of a fault, a signal is applied by wires 243 to a row fault location storage circuit 242 which is series connected between the row select circuit 222 and the row display drive circuit 241, and parallel connected to the row display drive circuit 241 and the SCR gate drive circuit 229 such that an output from either the SCR gate drive circuit 229 or an output from the row fault location storage circuit 242 will activate the row display drive circuit 241. The output wires 243 of the rapper check circuit 225 are also connected to the column display drive circuit 50 and the row select circuit 222 such that a column fault location storage circuit (FIG. 12) is activated and the row select circuit 222 is deactivated to cease operation.

FIG. 10 is a flow diagram of the operation of the sequencer 42, FIG. 1. Briefly, a coil signal 250 (in wire 219) from a field cycle time circuit 36 goes to an enable memory 252, from the latter to a read addressed memory location 254, thence, in sequence, to store memory output data 256, a write logic "1" into addressed memory location 258, a disable memory 260, an interrogate stored memory output data 262 and a decision element 264 having outputs which indicate whether or not the output data corresponds to an operated or unoperated rapper. If an operated rapper is indicated the sequence is referred to the enable memory 252 via advance address counter 266. This sequence is continued until the output data corresponds to an unoperated rapper.

Once output data corresponding to an unoperated rapper is indicated, the sequence proceeds to latch address data to output 270, thence in sequence to decode address data 272 to drive column SCR's 32, reset address clear stored memory output data 274, and end of rapper operation 278. The sequence stops until an end rapper operation signal from the oscillator/power supply 52 is applied via wire 56 at which time the sequence continues to clear latch address data to output 280 and thence to stop 282.

Figure 11:
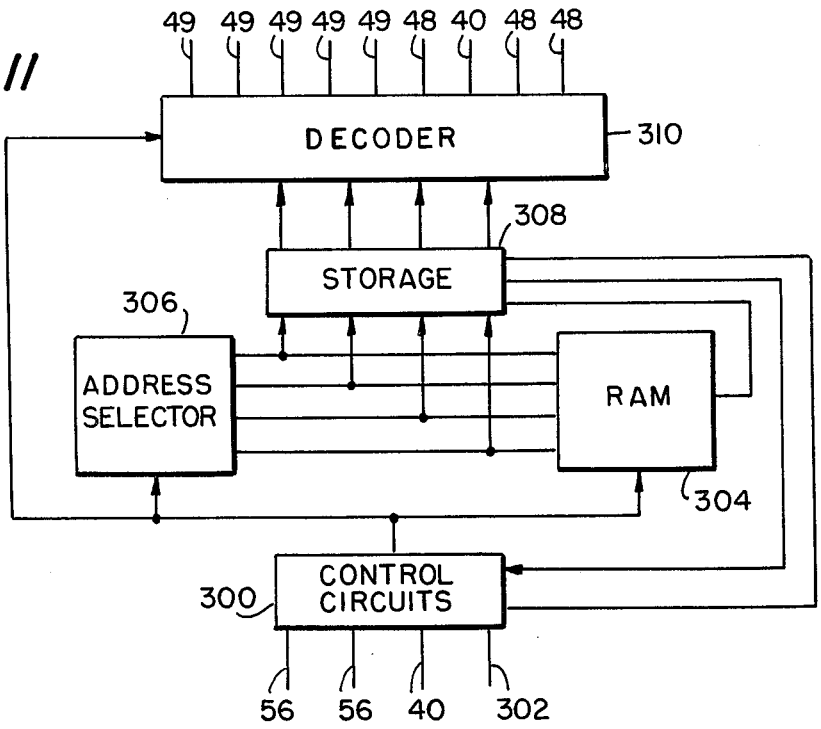
FIG. 11 is a block diagram of a portion of the sequencer including the random access memory functional interconnection.

FIG. 11 is a simplified block diagram of the sequencer circuit 42. It includes control circuits 300 which accept signals from the field cycle time circuits 36 through wires 40 and wave trains through wires 56 from the oscillator/power supply 52. Some of the wave trains conducted by wires 56 are shown in FIG. 8. A wire 302 from the column display drive 50 conducts the signal indicative of a faulty rapper generated in the field cycle time circuit and transmitted to the column display drive circuit 50 by wire 243 as discussed above. The control circuits 300 are signal routing circuits and they accept signals from the field cycle time circuits 36 and the oscillator/power supply 52 in the form of wave trains through wires 56 and interface these signals with a random access memory 304, address select circuits 306 and storage 308. The storage 308 contains means for retaining information provided by the address selector 306 and the random access memory 304.

The address selector 306 contains means for generating the necessary address codes to identify a single memory all within the random access memory 304. The random access memory 304 can be any suitable random access memory capable of temporary retention of information.

A decoder 310 receives the information from the address selector 306 via storage circuit 308 on a command from the control circuits and generates the signal necessary to enable the field cycle time circuits to select an appropriate row and enable the column display drive circuit 50 via one of the wires 49 to select an appropriate column on the display 84.

The decoder 310 also generates a signal to provide gate drive to one of the column SCR's 32 via one of the wires 48.

If a faulty rapper is detected, a signal through wire 302 cancels operation of the sequencer circuit 42.

In normal operation the sequencer circuit 42 would be disabled by a signal in the form of a wave train generated in the oscillator/power supply 52 and conducted to the control circuits 300 by one of the wires 56.

Figure 12:
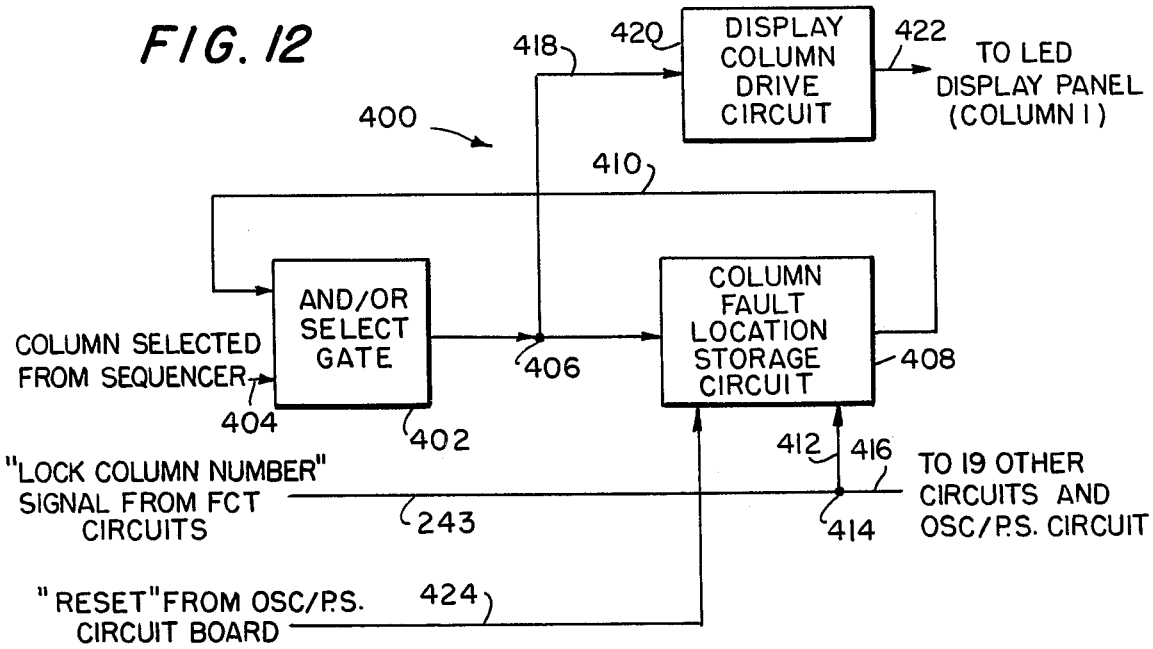
FIG. 12 is a block diagram of the display drive circuit (1 of 20).

A simplified block diagram of one of twenty similar circuits in the display drive 50 is shown in FIG. 12. Such a circuit indicated generally as 400 is provided with an and/or select gate 402 which receives a signal through one of the wires 49 indicating a selection by the decoder 310 on the sequencer circuit 42. The output of the gate 402 goes to a junction 406 having a wire connected to a column fault location storage circuit 408 which communicates through a return wire 410 to the gate 402. A second input 412 goes to the column fault location storage circuit 408 from a junction 414 in the wire 243 conducting a "lock column number" signal from the field cycle time circuit 36. The lock column number signal is conducted to nineteen other similar circuits by wire 416. A wire 418 from junction 406 goes to a display column drive circuit 420 having an output which is conducted through one of the wires 88 to the LED display 84.

The function of each of the twenty circuits 400 is to connect the wires 88 of the display 84 to the return side of the low voltage D.C. power supply 110 located in the oscillator/power supply 52, as long as a signal is present in wire 404. In the event that a rapper fault is detected, the column fault location storage circuit 408 is activated to provide a sustaining signal through wire 410 to the and/or select gate 402 maintaining the outputs of the display column drive circuit 420 regardless of the signal in wire 404 until a reset signal is applied through a wire 424 from the oscillator/power supply circuit 52 to the column fault location storage circuit 408.

The block diagrams of the invention have been used to reduce the number and complexity of the drawings and description of the invention. It is believed, however, that those skilled in the art of solid state circuits will clearly understand the details thereof, inasmuch as the components are in general use, and commercially available.

The invention provides a rapper control that is self-checking for faults in individual rappers, and also gives a running indication of the operation of all of the rappers being operated.

During operation the signals from the oscillator/power supply 52 include the clock signal wave train (FIG. 8) which is sent out over to all of the field cycle time circuits 36 and the wires 58 simultaneously.

In addition each field cycle time circuit receives a different inhibit signal depending on which row of rappers it is controlling. In FIG. 8, the numbers 1, 2, 3, 4 . . . *n* designate the row or rows controlled by the field cycle time circuit receiving the associated wave trains.

For the purpose of explanation any one of the inhibit wave trains, that is, the wave train *n*, will be considered. The clock signal is a series of pulses each one of which causes the round trip time control circuit 201 in each field cycle time circuit 36 to decrement the number presented by the round trip time thumbwheel switches 209 by one. When the value zero is reached, the round trip time control circuit 201 is considered armed. Subsequent application of an inhibit signal from the oscillator/power supply 52 causes an output to be produced and conducted through wire 221 to the row select circuit 222. Operation of any row of rappers can only occur during the time of the inhibit pulse duration. The duration of each inhibit pulse must be such as to allow one rapper to operate efficiently. This duration depends on rapper design and typically may be about 250 milliseconds.

If the rappers are to be arranged and controlled on a matrix basis, the maximum useful size of the matrix must be determined based on the intensity and frequency of operation of the rappers to efficiently clean the Precipitator, and the ease with which the two variables may be controlled with standard electronic circuits.

The intensity of the rapper may be controlled by varying either the phase angle of the applied voltage or the length of time that the voltage is applied to the rapper coil. The most important consideration for determining the matrix size is the maximum length of time that power must be applied for efficient rapping.

Tests indicate that a power application of 250 milliseconds duration is more than sufficient, and therefore, the time period alloted to each rapper in the matrix is defined as 0.25 seconds. The frequency, or more accurately, the time period between successive operations of the same rapper (Round Trip Time) and hence the time between operations of successive rappers in a Row is also important.

If the Round Trip Time is to be a minimum of 60 seconds, this means that for a matrix of $n$ Rows and $m$ Columns with a minimum Round Trip Time of 60 seconds, the time $t$, between operation of successive rappers in one Row must be:

$$t = RTT/m \quad (1)$$

where $RTT = 60$ seconds, and $m$ = number of columns.

To prevent simultaneous operation of two rappers (operating times overlap), $t$ must not be less than 0.25 seconds. This immediately establishes that for one row of rappers (1 Row $\times$ $m$ Column matrix) there can be no more than 240 rappers.

$$m = RTT/t = 60/0.25 = 240 \quad (2)$$

The rappers could be operated sequentially and never overlap so long as none of the rappers were energized for more than 0.25 seconds. This situation degenerates rapidly if two or more rows of rappers exist. In order to avoid simultaneous operation of rappers while preserving the conventional Round Trip Time concept in say a two row system, the first rapper in the first row may be operated for 0.25 seconds followed by the first rapper in the second row for the same duration. The second rapper in the first row would then operate followed by the second rapper in the second row, and so on. This establishes the fact that although the time $t$ between operation of successive rappers in a row is still:

$$t = 60/m \quad (3)$$

$t$ now also depends upon the number of rows of rappers. That is, $t$ must also be equal to the number of rows $n$, times 0.25 seconds or:

$$t = 0.25\,n \quad (4)$$

Equations (3) and (4) can be combined and rewritten in the form:

$$60/m = 0.25\,n \quad (5)$$

which reduces to:

$$m \cdot n = 240 \quad (6)$$

or:

$$m = 240/n \quad (7)$$

Of particular interest are the values for $n = 12$, and $n = 15$ since these are close to the theoretical maximum matrix size defined by:

$$n = m = (240)^{\frac{1}{2}} = 15.49 \quad (8)$$

With the number of rows $n$ equal to 12, equation (7) says the number of columns available will be 20. Also, from equation (3), the time between operations of successive rappers in any row will be 3 seconds with a Round Trip Time of one minute (60 seconds). With $n$ equal to 15, the number of columns is 16 and the time between successive rappers is 3.75 seconds. In either case, all conditions are satisfied for operation of a maximum practical matrix of rappers with a minimum Round Trip Time of one minute.

What is claimed is:

1. A system for controlling rapping of electrostatic precipitators in which the rappers comprise solenoids the coils of which are arranged in a matrix of rows and columns having corresponding wire circuits for conducting energizing current to each coil comprising an oscillator power supply providing timing pulse signals of uniform duration for controlling the time rectified A.C. pulses may be applied to each row of rappers;

a plurality of field cycle time circuits connected to said oscillator for controlling the round trip time of each row of rappers, the time each rapper in each row is energized and the current supplied to each rapper during energization;

means for checking each of said solenoids for short circuit and grounding prior to energization;

a sequencer circuit connected to said oscillator and said field cycle time circuits to provide a memory for the system, row controlled rectifier circuit each being connected to a field cycle time circuit and a corresponding rapper solenoid row wire circuit, and adapted to allow rectified A.C. pulses to be applied to a corresponding rapper solenoid row wire circuit; and column controlled rectifiers each connected to said sequencer circuit and a corresponding rapper solenoid column wire circuit, whereby the rectified A.C. pulses are conducted by said wires to said rapper solenoids such that the solenoids in each row are operated in sequence, one at a time only.

2. An electrostatic precipitator rapper control system as defined by claim 1, in which said field cycle time circuits provide signals of two types:

pulses to turn on the row controlled rectifier circuits with each pulse adjustable in duration, and signals to call the memory to ascertain which rapper solenoid in the controlled row should be next operated.

3. An electrostatic precipitator rapper control system as defined by claim 2, in which a column display drive is connected to said sequencer and said field cycle time circuits and indicia corresponding to each rapper solenoid is connected to said display drive by columns, and to said field cycle time circuits by rows, said indicia being arranged on a panel in horizontal rows and vertical columns corresponding to those of the rapper solenoids.

4. An electrostatic precipitator rapper control system as defined by claim 1, in which adjustable circuit means are provided for to control the round trip time of each row.

5. An electrostatic precipitator rapper control system as defined by claim 4, in which adjustable circuit means are also provided for setting the intensity of the current pulse applied to each row of rappers to set the rap intensity thereof.

6. A solid state system for controlling rapping of electrostatic precipitators in which the rappers comprise solenoids, the coils of which are arranged in a matrix of rows and columns having corresponding wire circuits for conducting energizing current to each coil comprising:

an oscillator;

a plurality of field cycle time circuits each connected to said oscillator and in communication with a row circuit, said field cycle time circuits provided with circuit control means for programming the time and intensity of rapping signals, a solid state sequencer having a memory for the system, connected to said oscillator and to the field cycle time circuits, controlled rectifier circuits connected in the row wire circuits and controlled rectifiers connected to the column wire circuits for operation by signals from said field cycle time circuits and sequencer, respectively, for triggering the controlled rectifiers so as to apply an energizing pulse to each solenoid in sequence, a virtue of said memory, with no overlap in the energization of the solenoids by virtue of signals from said oscillator.

7. A system for controlling rapping of electrostatic precipitators as defined by claim 6, including a bank of indicia arranged on a display panel in an array corresponding to that of said rappers, an electronic drive circuit for energizing each indicia when the corresponding rapper is operated, providing a running display of rapper operations, so that should a fault occur in a rapper, the corresponding indicia indicates exactly where the corresponding rapper at fault is located.

8. A system for controlling rapping of electrostatic precipitators as defined in claim 7 wherein said indicia comprises light emitting diodes.

9. A system for controlling rapping of electrostatic precipitators as defined in claim 7, in which a check circuit is provided for automatically testing each rapper before the latter is energized, so that should a rapper be grounded or shorted the rapper will not be energized and the corresponding indicia on the display indicates such ground or short until reset, while the system otherwise continues to operate.

10. A solid state control system for applying rectified A.C. pulses of selected intensity to cross wires of a matrix of rows and columns of individual rapper solenoid coils the terminals of which are connected to said wires adjacent the crossings thereof for continuously supplying said coils with such pulses in sequence one after another by row and column, comprising solid state circuit means for automatically distributing to said wires said pulses in a certain timed sequence such that the wires of one parallel set are connected in turn to the pulse source and the wires of the other set are connected in turn to said pulse source as each wire of the first set is connected thereto, whereby each coil is energized in sequence one after the other.

* * * * *